US007815363B2

(12) United States Patent
Buttet et al.

(10) Patent No.: US 7,815,363 B2
(45) Date of Patent: Oct. 19, 2010

(54) MOVEMENT FOR A TIMEPIECE WITH PLURAL ESCAPEMENTS

(75) Inventors: Mathias Buttet, Divonne les Bains (FR); Enrico Barbasini, Ambilly (FR); Michel Navas, Collonges (FR)

(73) Assignee: BNB Concept SA (CH)

( * ) Notice: Subject to any disclaimer, the term of this patent is extended or adjusted under 35 U.S.C. 154(b) by 362 days.

(21) Appl. No.: 11/909,571

(22) PCT Filed: Mar. 23, 2005

(86) PCT No.: PCT/EP2005/003090

§ 371 (c)(1),
(2), (4) Date: Nov. 29, 2007

(87) PCT Pub. No.: WO2006/099882

PCT Pub. Date: Sep. 28, 2006

(65) Prior Publication Data

US 2008/0192583 A1 Aug. 14, 2008

(51) Int. Cl.
*G04B 15/00* (2006.01)

(52) U.S. Cl. ..... 368/124; 368/125; 368/127; 368/168; 368/169

(58) Field of Classification Search ..... 368/124, 368/125, 127, 168, 169
See application file for complete search history.

(56) References Cited

U.S. PATENT DOCUMENTS

| | | | | |
|---|---|---|---|---|
| 3,633,354 | A | 1/1972 | Stemmler | |
| 4,684,260 | A * | 8/1987 | Jackle | 368/16 |
| 7,350,966 | B2 * | 4/2008 | Zaugg | 368/140 |
| 2003/0193842 | A1 * | 10/2003 | Harrison | 368/82 |

FOREIGN PATENT DOCUMENTS

| | | |
|---|---|---|
| CH | 156 801 | 8/1932 |
| CH | 156801 | 8/1932 |
| EP | 1577716 | 9/2005 |
| GB | 2375619 A * | 11/2002 |

OTHER PUBLICATIONS

International Search Report dated Jun. 23, 2006 issued in corresponding PCT International Application No. PCT/EP2005/003090.

* cited by examiner

*Primary Examiner*—Vit W Miska
*Assistant Examiner*—Jason Collins
(74) *Attorney, Agent, or Firm*—Ostrolenk Faber LLP

(57) ABSTRACT

A timepiece movement having at least two regulating members with their escapement and elements for alternately stopping and releasing the operation of the regulating members, such that a single regulating member is thus driven at any one time by means of the energy source of the timepiece.

14 Claims, 5 Drawing Sheets

MOVEMENT FOR A TIMEPIECE WITH PLURAL ESCAPEMENTS

CROSS-REFERENCE TO RELATED APPLICATIONS

The present application is a 35 U.S.C. §§371 national phase conversion of PCT/EP2005/003090, filed Mar. 23, 2005, the disclosure of which has been incorporated herein by reference. The PCT International Application was published in the French language.

TECHNICAL FIELD

A main object of the invention is to provide a movement for a timepiece arranged so as to be able to use, on demand or automatically, one escapement or another present in the same watch. A main aim is to be able to count the time through one escapement or another in an amusing and practical manner, as for example during two periods of twelve hours. In a preferred exemplary embodiment of the invention, the disclosed movement has two regulating members with their escapement, in particular two tourbillon frames that function alternately during two periods of twelve hours, that is to say day and night.

PRIOR ART

Currently, in order to indicate the day and night (AM/PM), several systems are used. The most simple consists of an hour hand indicating the hour on a dial of twenty four hours distributed over the 360° circumference of the dial. One known variant is a window formed in the dial that indicates whether it is day or night, for example with the indication AM and PM. It is also possible to provide animations on the frame representing alternately the sun and moon over a period of twice twelve hours. Finally, it is possible to display the hours ranging from one to twenty four hours digitally.

DISCLOSURE OF THE INVENTION

A main object of the invention consists in providing a novel movement that may be capable, through its arrangement, of counting the time by means of one or more escapements, but at least two used in alternation.

The invention may apply in principle to a mechanical movement of a timepiece. It can however equip an automatic movement or a small clock. Finally, it may also equip an electrical or electronic watch regulated by at least two regulating systems provided with a mechanical escapement.

The movement for a timepiece according to the invention may comprise at least two regulating members with their escapement and means for alternately stopping and releasing the operation of the regulating members, only one of the regulating members being driven at a time by means of an energy source.

The energy source may preferably be connected to the regulating members by means of a differential.

The mechanism may drive alternately regulating members of the same type and regulating members of different types.

In a preferred embodiment, the regulating members may be tourbillons.

Obviously the regulating members may drive escapements of the Swiss type, English type or other types of escapement.

The movement may have means for ensuring the change from one escapement to another by means of a manual control.

The change from one escapement to another may also be provided by control means pre-existing in the timepiece and arranged to effect the said change during predetermined periods of time. In this case, the control for the change from one escapement to another may, for example, be effected using a cogwheel connected to the hour wheel of the watch movement.

The means arranged to effect the change from one escapement to another may act over periods of twelve hours representing the day and night.

The regulating members may support a circular sign depicting the sun or representing the moon. The signs representing the sun and moon can be fitted with precious stones, and the sign of the moon may also support diamonds. Alternately, the regulating member depicting the night may be placed above a dish covered with a fluorescent or phosphorescent material arranged to store the light during the day and restore it during the night.

The regulating members and their escapement may be visible through a window formed in the dial. Alternatively, the regulating members and their escapement may be visible alternately behind a cut-out part of a disc pivoting in the timepiece and arranged so as to be driven by a mobile of the movement of the piece in order to effect a complete turn according to a predetermined period of time, for example every twenty four hours.

The means for alternately stopping and driving the regulating members and their escapement may comprise a wheel with arms or lugs placed opposite the seconds mobile of the escapement or the teeth of the tourbillon frame of each of the regulating members of the movement, the wheels with lugs being driven by a setting wheel integral with a star wheel, itself controlled by a pin actuated by the hour wheel of the movement, the positioning of the star being effected, after the advance given by the pin, by the positioning action of a jumper, so as to bring the lug in contact with the teeth of the cage or the seconds wheel of the escapement and lock the said frame or wheel, while the lug of the other regulating members is disengaged from the teeth of the frame or the seconds wheel of the escapement, after having given an impulse to the said frame or to the seconds wheel of the escapement in order to start the regulating member or tourbillon.

The energy source driving alternately the regulating members or the tourbillons may comprise a barrel connected to a differential in kinematic connection with all the escapements or tourbillons, the differential having a roller mounted freely on a first spindle and coaxial with a first pinion driven by the barrel, the first pinion meshing with a second pinion rotating freely on a second spindle, situated on the roller while being parallel to the first spindle, the second pinion being integral and coaxial with a third pinion meshing with a fourth pinion firmly fixed to a toothed wheel, also mounted free on the first spindle in order to drive one of the frames while the other frame is driven directly by the roller, the rotation of one of the third and fourth pinions with respect to the first spindle being locked when one of the frames is stopped and free when the latter is being driven.

BRIEF DESCRIPTION OF THE DRAWINGS

The drawing depicts by way of example an embodiment of the timepiece that is the object of the invention.

In the drawing.

EMBODIMENT(S) OF THE INVENTION

Figure 1:
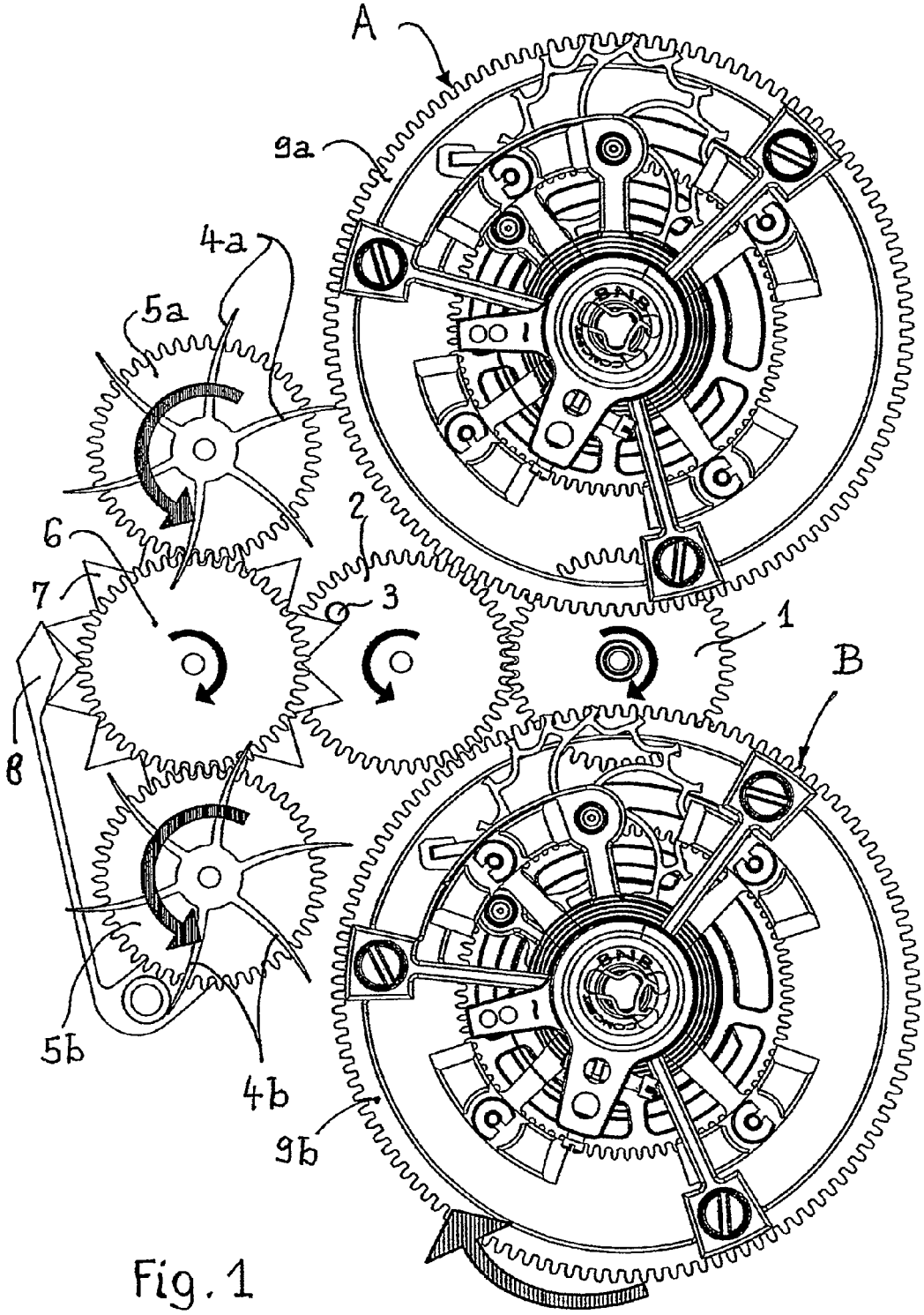
FIG. 1 is a schematic view from above of the movement of a timepiece having two tourbillons actuated alternately during periods of twelve hours by a starting and stopping device for the tourbillon frames.
Figure 2:
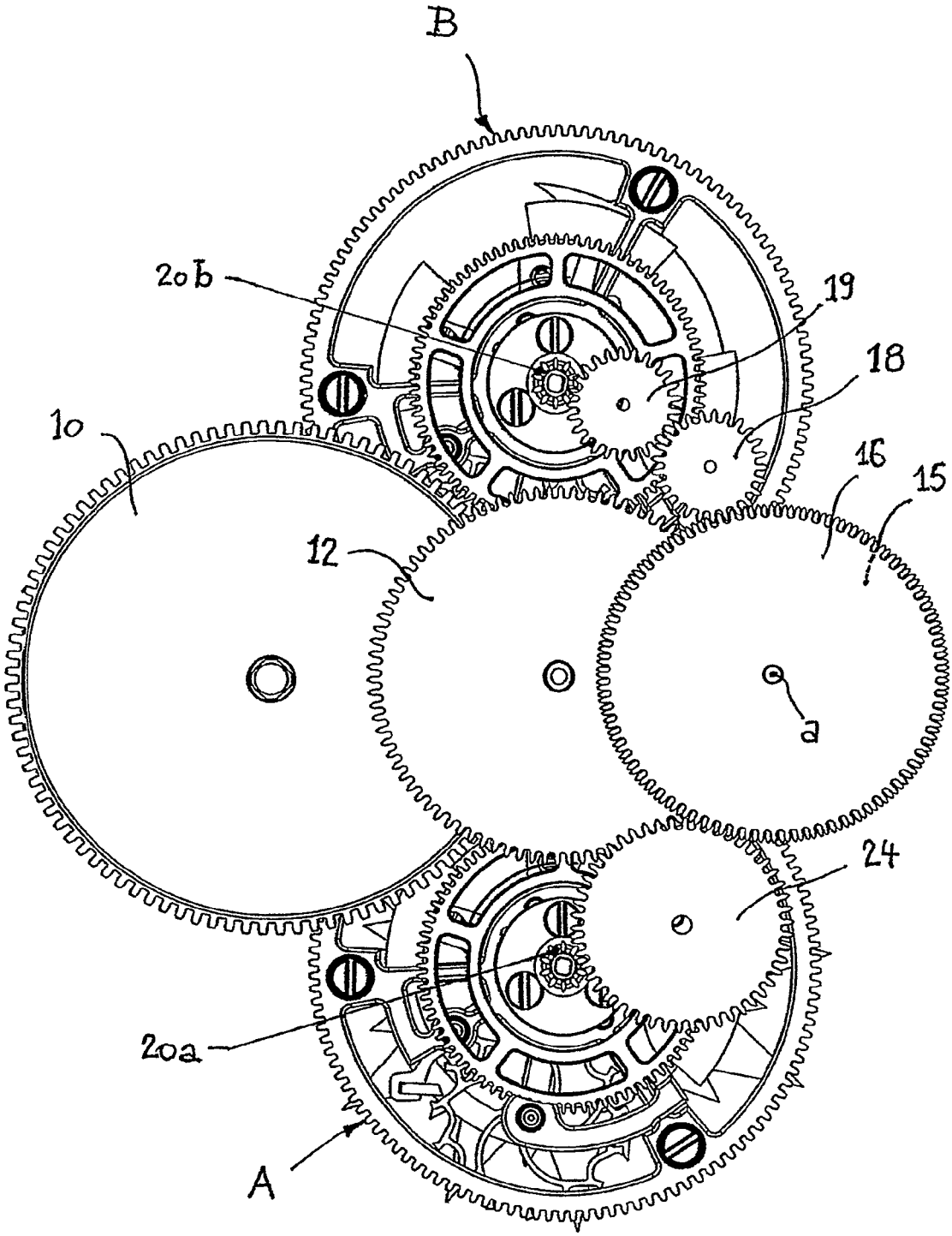
FIG. 2 is a view from below of the movement of FIG. 1.
Figure 3:
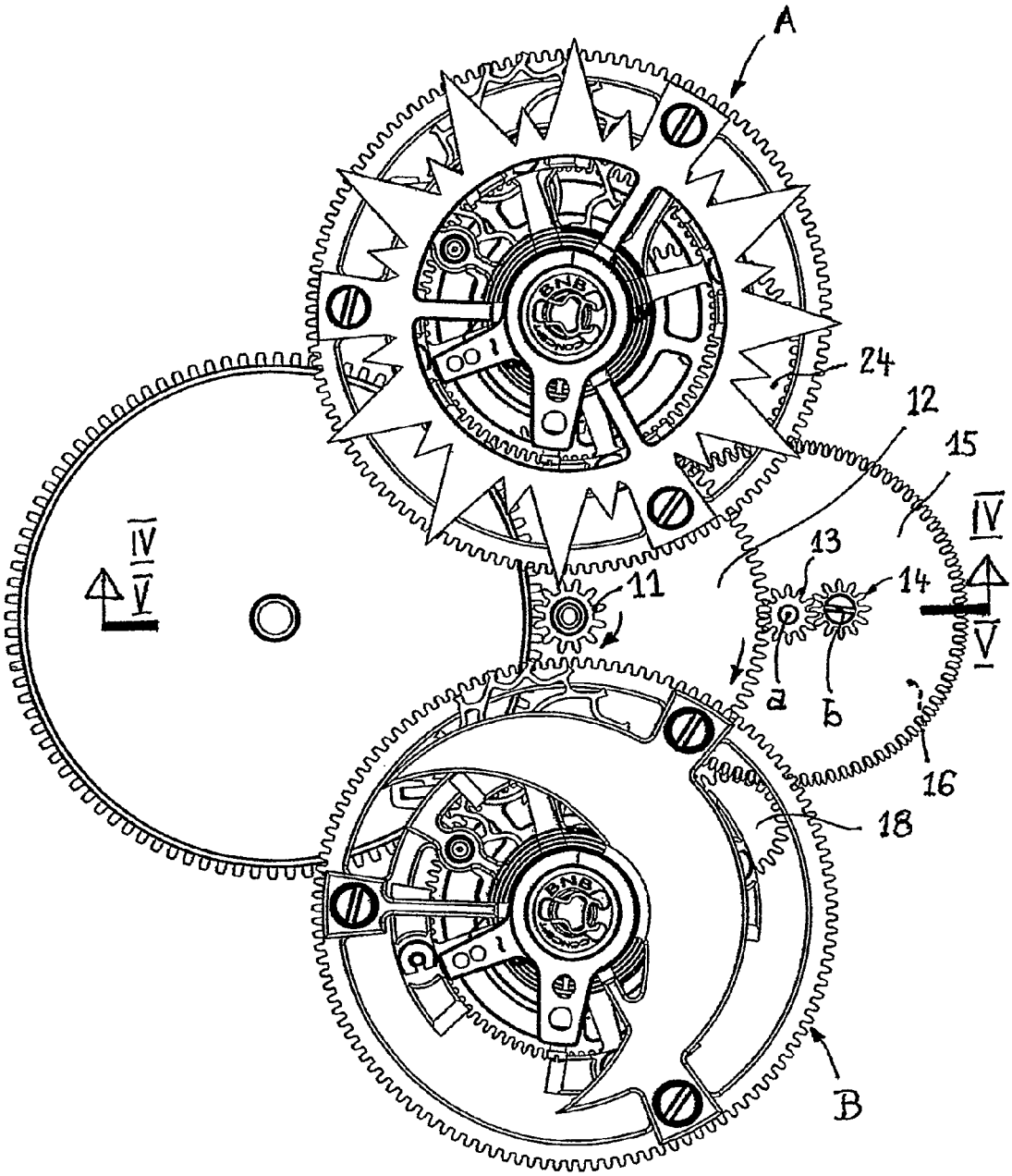
FIG. 3 is a view from above of the movement of FIGS. 1 and 2 showing in particular the alternating energy distribution to the frames of the tourbillons.
Figure 6:
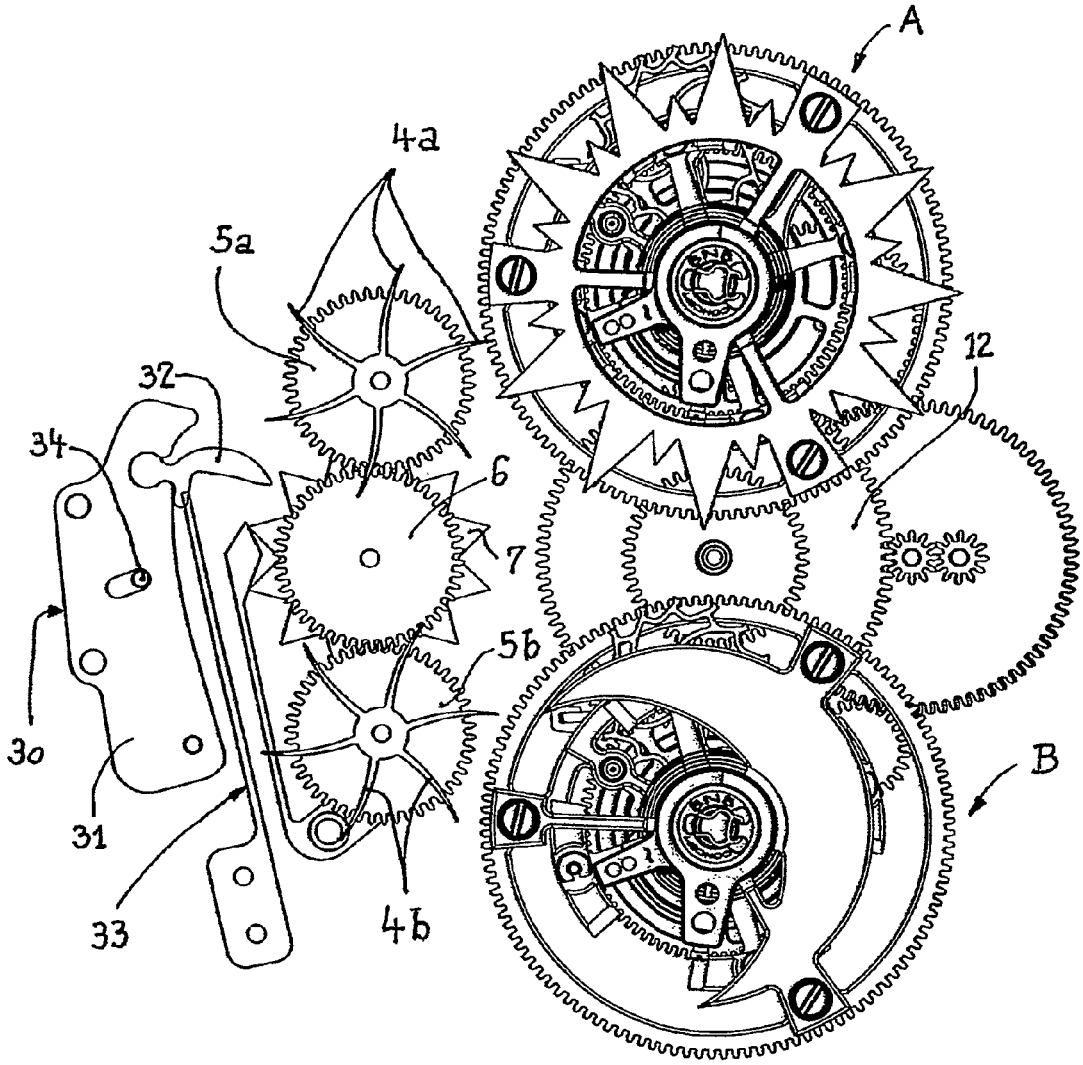
FIG. 6 is a view of a variant of the device for starting and stopping the tourbillons of FIG. 1, the variant making it possible to actuate tourbillons alternately by means of a manual control.

The movement depicted in FIG. 1 comprises a tourbillon frame A and a tourbillon frame B depicted one above the other in FIG. 1; the two tourbillon frames A and B will be visible through windows, not shown, in the dial of the timepiece and it is accepted that the frame A will represent the twelve hours of the day and the frame B the twelve hours of the night. As depicted in FIGS. 3 and 6, the frames A and B are provided with a figure representing the rays of the sun, or respectively a moon for indicating the day and night. The two tourbillon frames A and B with their escapement are visible all the time on the dial side and merely stop alternately in periods of twelve hours thus indicating the day and night periods. As shown in FIGS. 3 and 6 the design of these tourbillon frames makes it possible to identify in one case the sun and in the other a crescent moon.

In a variant, a sector disc of approximately 180°, not shown, could be fixed to a mobile effecting one turn in twenty four hours, pivoting coaxially with the cannon pinion and the standard arrow wheel covering alternately one of the two tourbillon frames every twelve hours. In this case, the top one in FIG. 1 would symbolise the day and the bottom one the night. Irises, not shown and similar to lenses for photographic apparatus, can be integrated in the watch dial in order to open alternately every twelve hours in order to reveal the tourbillon frames for periods of twelve hours.

Finally, the night tourbillon frame can be placed in a dish covered with a fluorescent or phosphorescent material so as to be charged with light during the day when this frame is stopped and to restore it during the night by irradiating diamonds inserted in the frame.

The alternating start and stop function of the frames is controlled from the hour wheel 1 of the movement, which makes one turn in twelve hours.

The hour wheel 1 of the movement of the timepiece (FIG. 1) drives a mobile 2 to which a pin 3 is firmly fixed. This mobile 2 executes one turn in twelve hours. The pin 3 every twelve hours drives a star 7 by one step. The latter is positioned angularly by the jumper 8. The star 7 is firmly fixed to the setting wheel 6 and when the star 7 is positioned under the action of the jumper 8, the setting wheel 6 drives the setting wheels 5*a* and 5*b*.

The wheel with arms 4*a* is firmly fixed to the setting wheel 5*a* and the wheel with arms 4*b* is firmly fixed to the setting wheel 5*b*.

The arms of the wheels 4*a* and 4*b* come into collision with respectively the teeth of the toothed top bridges 9*a* and 9*b* of the tourbillon frames A and B, alternately every twelve hours.

During one jump of the star 7, the movement is transmitted to the setting wheel 6 meshing with the wheel 5*a*. At this moment, one of the arms of the wheel 4*a* locks the frame A, while at the same moment the wheel 5*b* also meshing with the setting wheel 6 releases the frame B by means of the movement of the arms 4*b*.

In addition, when the frame is released by one of the arms of the wheels 4*a* or 4*b*, the rapid circular movement executed by the wheels 4*a* or 4*b* following the action of the jumper 8 gives alternately an impetus to the frames A and B so as to start or help with the starting of the regulating systems.

When the movement of the timepiece is regulated alternately by two or more regulating members that are not tourbillons as described by means of FIGS. 1 and 6 of the drawing, the arms or lugs of the wheels 4*a* and 4*b* can come into collision with and come to lock for example the seconds wheel placed between the barrel 10 (FIG. 1) and the escape pinion of the regulating member. Moreover, when the arms or lugs of the wheels 4*a* and 4*b* release the seconds wheel connected to the escape pinion, the action of the jumper 8 at the time of positioning of the star 7 will give an impulse to the arms or lugs 4*a* and 4*b* on disengagement, which will make it possible to restart the regulating member or assist it to restart.

The distribution of energy to the regulating members is shown and described with regard to FIGS. 2, 3, 4 and 5.

The energy of the barrel 10 is transmitted to the centre pinion 11, and the centre wheel 12 is firmly fixed to the centre pinion 11. The energy is transmitted to the first free pinion 13 on the first rotation spindle a (FIG. 3). The first pinion 13 meshes with the second pinion 14 mounted so as to rotate on the second rotation spindle b. The pinion 14 is firmly fixed to the third pinion 21 (see also FIG. 4).

These two pinions 14 and 21 pivot about the spindle b eccentric with respect to the spindle a of the wheel 15 and are free to rotate in the wheel roller 15 about the spindle b, the roller 15 being mounted so as to rotate on the first spindle a. The third pinion 21 meshes with a fourth pinion 22 firmly fixed to the wheel 16. The mobile composed of the wheel 16 and pinion 22 is free on the spindle a.

Figure 4:
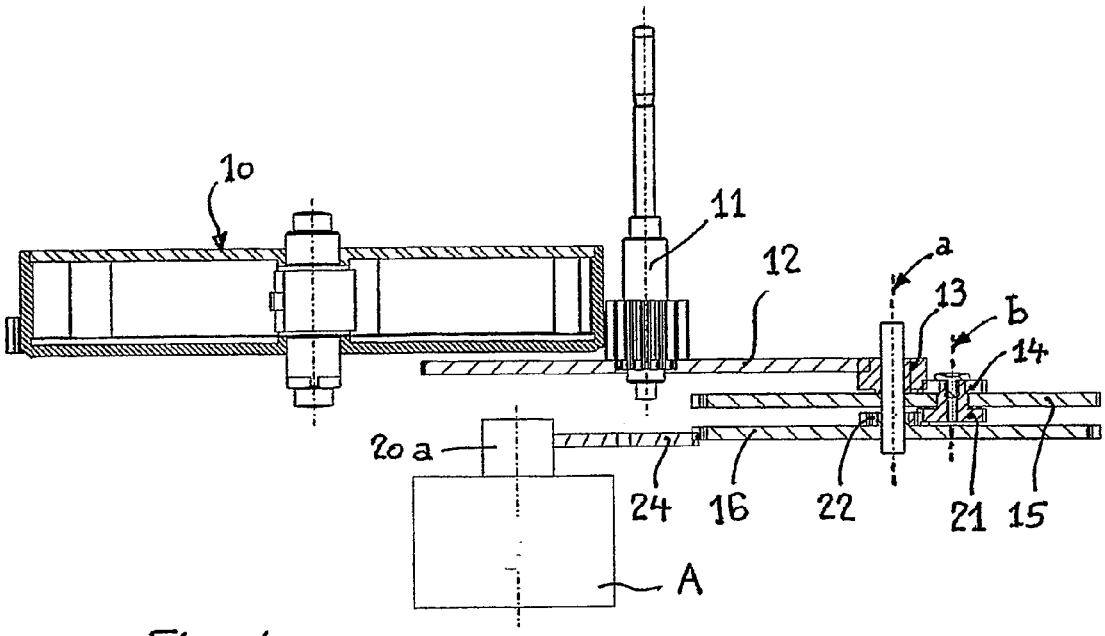
FIGS. 4 and 5 depict sections along the lines IV-IV and V-V of FIG. 3, the section IV-IV being extended towards the axis of the frame A and the section V-V towards the axis of the frame B.

To make the frame A function when the frame B is stopped, the wheel 16 transmits its energy and rotation movement to the setting wheel 24, and then to the frame pinion 20*a* (FIG. 4).

Figure 5:
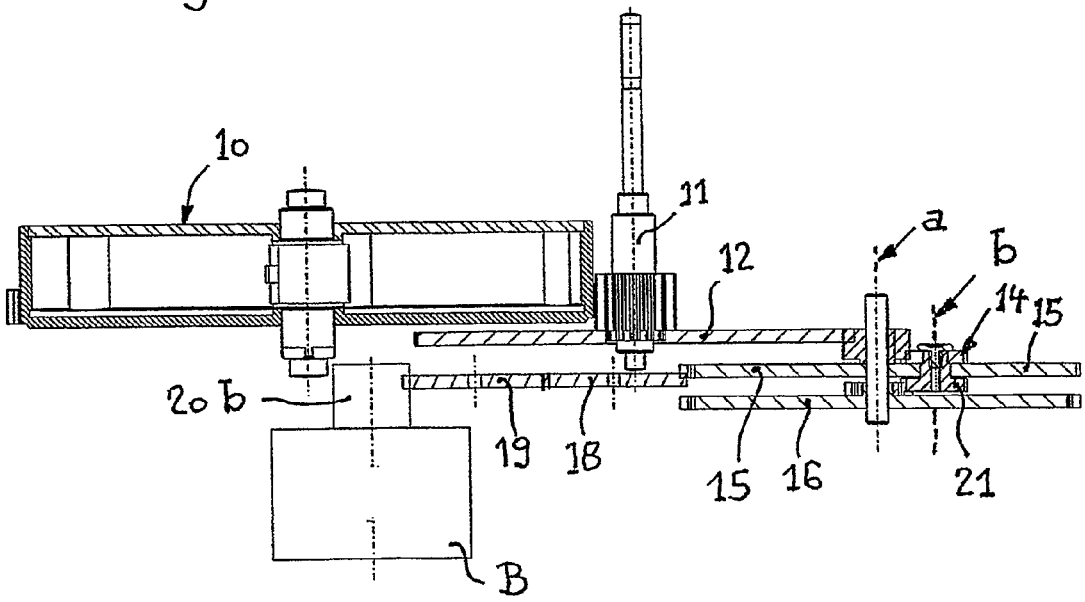

To make the frame B function when the frame A is stopped, the energy and rotation movement are transmitted from the wheel 15 to the setting wheel 18 and then onto the setting wheel 19 and, finally, onto the frame pinion 20*b*. Two setting wheels are necessary in this case so that the frame of the tourbillon B turns in the clockwise direction (FIG. 5).

To understand the principle of changing from one escapement to the other, it is necessary to recall that the mechanism has only one barrel (energy source) but contains at least two different escapements, functioning alternately.

The amplitude of a balance wheel in a standard mechanism depends, amongst other things, on the energy available in the counting gear train distributed by the barrel. It will therefore be understood that, if the two balance wheels wished to function simultaneously, the barrel would not distribute sufficient energy and, in the converse case, if the barrel distributed twice as much energy, one of the two balance wheels would receive too much energy when the other is stopped. It is therefore essential to manage the force distribution of a single barrel to one or other of the two escapements.

Thus, when the frame A is locked by the arms of the wheel 4*a*, the frame B turns in the clockwise direction. The transmission of energy from the barrel 10 to the pinion 14 takes place by means of the centre mobile 11, the centre wheel 12 and the pinion 13.

When the frame A is locked, the setting wheel 24, the wheel 16 and its pinion 22 are fixed (FIG. 4).

The transmission of energy from the barrel 10 passes through the pinion 14 firmly fixed to the pinion 21 rotating about the pinion 22, which is rotationally locked, thus driving the roller 15. The roller 15 drives the setting wheels 18 and 19, and then the frame pinion 20*b* (FIG. 5).

When the frame B is locked by one of the arms of the wheel 4*b*, the frame A turns in the clockwise direction. The setting wheels 18, 19 and the roller 15 are then fixed.

Since the mobiles 14 and 21 are firmly fixed to the roller 15, the spindle b has a fixed position with respect to the first spindle a, but is free to rotate on itself (differential gearing). The energy coming from the barrel 10 is transmitted to the mobile 13, and then to the mobiles 14 and 21 driving in rotation the mobile formed by the pinion 22 and the wheel 16. The drive next passes through the setting wheel 24 and then through the frame pinion 20*a*.

FIG. 6 depicts in a variant the principle of the change from one escapement to the other on demand from the user.

Instead of allowing the mechanism to time the change from one escapement to another automatically, as described above in the indication of an AM/PM in FIGS. 1 to 5, it is possible to imagine adapting a control pusher so that, manually and on demand, it is possible to determine which escapement receives the energy from the barrel.

For this purpose it suffices to remove the setting wheel 2 and its pin 3 (FIG. 1) and to act directly by means of a pusher 30 (FIG. 6), composed of two parts 31 and 32, on the star 7.

The spring 33 has two functions:

Firstly, it makes it possible to reposition the pusher 30 against the pin 34.

Secondly, to position the piece 32 in abutment on the piece 30.

In this way, at each impulse from the pusher 30, one frame stops and the other starts.

The mechanism that has just been described with regard to FIGS. 1 to 5 makes it possible, for example every twelve hours, to actuate automatically sometimes one tourbillon frame, sometimes the other. It would also be possible to pass from one frame to the other, for example every hour, by making one tourbillon frame function all the even hours and the other all the odd hours.

The mechanism makes it possible to transmit energy from the barrel of one tourbillon frame to the other without disengaging and without losing energy. In other words, when the counting gear train leaves one of the two frames, it is already meshing with the other frame.

The end wearer of the watch will thus see a tourbillon frame losing its amplitude in a natural way (the balance wheel will take more than a minute to stop by itself), while in a few seconds the other frame receiving the energy from the barrel will take up amplitude almost instantaneously.

As mentioned above, the mechanism makes it possible to stop and actuate all other kinds of escapement, for example a standard Swiss anchor escapement and a standard balance wheel, automatically, programmed or on demand from the user.

The mechanism also makes it possible to activate, during a given period of time, one type of escapement, for example a detent escapement, then, during another given period of time, an escapement of another type (standard Swiss anchor escapement or other), etc. It thus gives the possibility of producing a mechanism passing from two to X positions able to supply a veritable "museum of escapements". It would be possible, amongst other things, to show the escapements in a historical fashion, for example by putting an English escapement with a Swiss one and by making them function alternately during a given period of time.

The mechanism that has just been described has the following advantage:

It is possible quite simply to say that the time counted by a watch containing several escapements is more precise than by a watch containing only a single escapement since, at the end of a period of twenty four hours, the time counted is the arithmetic mean of all the times counted by the different escapements. The advantage also consists of causing wear on the components of the assortment at least 50% less than normal.

The invention claimed is:

1. A movement for a timepiece comprising at least two regulating members, each regulating member comprising an escapement, a device for alternately stopping and releasing the running of each said regulating member, wherein only one of said regulating members is driven at any one time by an energy source, said device for alternately stopping and driving said regulating members and their escapement comprises a wheel with arms or lugs placed opposite a seconds mobile of said escapement or teeth carried by a frame of a tourbillon of each of said regulating members of the movement, said wheel with arms or lugs being arranged so as to be driven by a setting wheel that is integral with a star wheel, said star wheel being controlled by a pin actuated by an hour wheel of the movement, a jumper configured for providing positioning action for positioning of said star wheel after an advance of the star wheel by the pin for bringing one of the lugs in contact with said teeth on said second frame or said seconds wheel of said second escapement and lock said frame or wheel, while one of said lugs is arranged so as to disengage from said teeth on said first frame or from said seconds wheel of said first escapement, after having given an impulse to said first frame or to said seconds wheel of said first escapement in order to start the corresponding said regulating member or tourbillon.

2. The movement of claim 1, wherein said energy source is connected to the regulating members by a differential.

3. The movement of claim 2, wherein said energy source alternately driving said regulating members or said tourbillons comprises a barrel connected to said differential in kinematic connection with all of said escapements or tourbillons, said differential having a roller mounted freely on a first spindle with a first pinion coaxial with said roller and driven by said barrel, said first pinion meshing with a second pinion integral and coaxial with a third pinion rotating freely on a second spindle carried by said roller while being parallel to said first spindle, said third pinion meshing with a fourth pinion firmly fixed to a toothed wheel, mounted free on said first spindle in order to drive said first frame, while said second frame is arranged so as to be driven directly by said roller, said roller being locked when said first frame is driven and rotating freely when said first frame is stopped.

4. The movement of claim 1, wherein said regulating members are of a same type.

5. The movement of claim 1, wherein said regulating members are of different types.

6. The movement of claim 1, wherein said escapements are of the Swiss type or the English type.

7. The movement of claim 1 further comprising a manual control for controlling the change from one escapement to the other.

8. The movement of claim 1, further comprising a gear train, and an element of said gear train is arranged to cause change from one escapement to the other periodically in a predefined period.

9. The movement of claim 8, wherein said predefined period is twelve hours representing day and night.

10. The movement of claim 1, wherein one of said regulating members is active during a period of time representing the night and is placed above a dish covered with a phosphorescent or fluorescent material.

11. The movement of claim 1, wherein one of said regulating members supports a sign representing the sun, and the other one of said regulating members supports a sign representing the moon.

12. The movement of claim 11, wherein precious stones decorate said signs.

13. A timepiece comprising a movement according to claim 1, wherein said movement is surmounted by a dial, and said regulating members being visible through a window formed in said dial.

14. A timepiece comprising a movement according to claim 1, the timepiece comprising a cut-out part of a disc mounted so as to pivot with reference to said movement and arranged so as to be driven by a mobile of said movement in order to effect a complete turn according to a predetermined period of time so that said regulating members are visible alternately through said cut-out part.

* * * * *